US005195300A

United States Patent [19]

Kovacs et al.

[11] Patent Number: 5,195,300

[45] Date of Patent: Mar. 23, 1993

[54] COMPRESSED ROLL PACKAGING METHOD AND APPARATUS

[75] Inventors: Lloyd Kovacs; Dale J. Young, both of Sheboygan, Wis.

[73] Assignee: Hayssen Manufacturing Company, Sheboygan, Wis.

[21] Appl. No.: 852,794

[22] Filed: Mar. 17, 1992

[51] Int. Cl.[5] ..... B65B 63/02; B65B 9/20; B65B 35/44

[52] U.S. Cl. ..... 53/438; 53/439; 53/450; 53/529; 53/530; 53/546; 100/3; 100/207

[58] Field of Search ..... 53/438, 439, 529, 450, 53/550, 546, 530, 449; 100/3, 183, 151, 153, 166, 207

[56] References Cited

U.S. PATENT DOCUMENTS

| | | | |
|---|---|---|---|
| 2,962,848 | 12/1960 | Wilson | 53/530 |
| 3,581,457 | 6/1971 | Gerlach et al. | 53/546 X |
| 3,587,201 | 6/1971 | Strayer | 53/438 |
| 3,717,973 | 2/1973 | Brady, Jr. | 53/530 |
| 3,729,886 | 5/1973 | Lucas et al. | 53/530 X |
| 3,837,138 | 9/1974 | Terry | 53/439 |
| 4,592,193 | 6/1986 | Gustavsson | 53/530 |
| 4,679,379 | 7/1987 | Cassoli | 53/530 X |
| 4,756,141 | 7/1988 | Hirsch et al. | 53/438 |
| 4,762,061 | 8/1988 | Watanabe et al. | 53/439 X |

*Primary Examiner*—Horace M. Culver
*Attorney, Agent, or Firm*—Lee, Mann, Smith, McWilliams, Sweeney & Ohlson

[57] ABSTRACT

A method and apparatus for packaging a plurality of cylindrical paper rolls in a compressed state. Rolls are conveyed in a side-by-side relationship and are first progressively compressed in the vertical direction to a partially compressed state. The compressed rolls are then rotated 90° to orient their flattened dimension vertically, and are further compressed as they are further conveyed. The compressed rolls are then joined, wrapped in a plastic flim, and the film is sealed to package the rolls and retain the rolls in their compressed state.

19 Claims, 4 Drawing Sheets

COMPRESSED ROLL PACKAGING METHOD AND APPARATUS

BACKGROUND OF THE INVENTION

This invention relates to methods and apparatus for packaging paper rolls, and in particular to a method and apparatus for packaging a plurality of cylindrical paper rolls in a compressed state.

Cylindrical paper rolls, such as toilet paper or paper towels, are formed with hollow cores, and are quite typically packaged in groups of multiple rolls encased in a plastic film. Machinery for doing so has been manufactured for many years by Hayssen Manufacturing Company, assignee of the present application, under the "ULTRAFLOW" trademark.

Typically, roll wrapping machinery of the nature of the present application comprises an in-feed conveyor where rolls are introduced to the machine, followed by a forming shoulder overhead, where rolls are aligned and conveyed forwardly to a forming shoulder, where the rolls are introduced into a perforated elongated plastic film which has been formed into a tube. The film is longitudinally sealed, and is advanced with the entrained product to a separating apparatus, where the tube is periodically severed along the perforation lines into individual packages. The open ends of the packages are then tucked and sealed to complete the package.

While such machinery provides very satisfactory packages and is in use worldwide, one detriment of any such equipment is the fact that the rolls being packaged have hollow cores and are cylindrical, and therefore quite a quantity of dead space is packaged along with the rolls. The object of the present application is to eliminate as much dead space as possible by precompressing the rolls and packaging the rolls in a compressed state.

SUMMARY OF THE INVENTION

The invention provides a method and apparatus for packaging a plurality of cylindrical paper rolls in a compressed state where at least two rolls are initially oriented in a generally side-by-side relationship having their longitudinal axes parallel and horizontal. Means is provided for conveying the rolls in a direction of travel parallel to the longitudinal axes of the rolls. Further means is provided for progressively compressing the rolls to a partially compressed state such that each roll has a generally elliptical cross section with a major cross-sectional axis. Means is next provided for orienting the partially compressed rolls with their major cross-sectional axes aligned, spaced a first predetermined distance from one another, and parallel to one another. Then, means is provided for further compressing the rolls to a compressed state so that the major cross-sectional axes of the rolls are spaced apart a second predetermined distance which is less than the first predetermined distance. Finally, means is provided for sealing the rolls in a package while in the compressed state.

In accordance with the preferred form of the invention, the means for conveying the rolls comprises a bottom conveyor located beneath the rolls, and the means for progressively compressing the rolls comprises at least one compacting conveyor located above the bottom conveyor. Means is provided for angling the compacting conveyor in the direction of travel of the rolls in order to reduce the spacing between the conveyors to compress the rolls as they are conveyed. The means for angling comprises a compression plate bearing against the compacting conveyor, and includes an adjustment mechanism attached to the plate to alter the spacing between the conveyors by altering the vertical orientation of the plate.

The means for orienting the rolls after they have been partially compressed includes a chute for each roll and a lifting guide or rail in each chute at one side of the chute. The lifting rails are upwardly inclined in the direction of travel of the rolls so that once the roll has passed by the rail, the roll is oriented with its major cross-sectional axis located vertically. The thus-oriented rolls are then accelerated to the means for further compressing.

In the further compressing means, a lane is provided for each roll, and each lane includes means for further compressing a roll. An overhead conveying means is provided to engage each of the rolls and transport the rolls in unison.

The overhead conveying means comprises a plurality of spaced flights revolving through a fixed path, each flight comprising a horizontal beam and a series of paddle arms. At least some of the lanes converge toward one another, and a pair of the paddle arms is shiftably mounted on opposite ends of the beam to accommodate the convergence of the lanes. Each shiftable arm includes a detent roller in registration with the beam, and the beam includes a pair of corresponding detents associated with each shiftable arm, with the detent roller engaging the detents to temporarily hold the shiftable arms at one of two locations. Each arm also includes a cam roller, and a cam is provided in registration with each cam roller to shift the shiftable arms as required during the revolving path of the flight.

When the aligned and compressed rolls exit the overhead conveying means, they enter the sealing means, which includes means for forming an elongated plastic film into a tube with lapped edges. Means is provided for heat sealing the lapped edges, and downstream means is provided for separating the tube into sections, each section having entrained product therewithin, and means is finally provided for folding and sealing the opposite ends of each tube section.

DESCRIPTION OF AN EXAMPLE EMBODYING THE BEST MODE OF THE INVENTION

Figure 1:
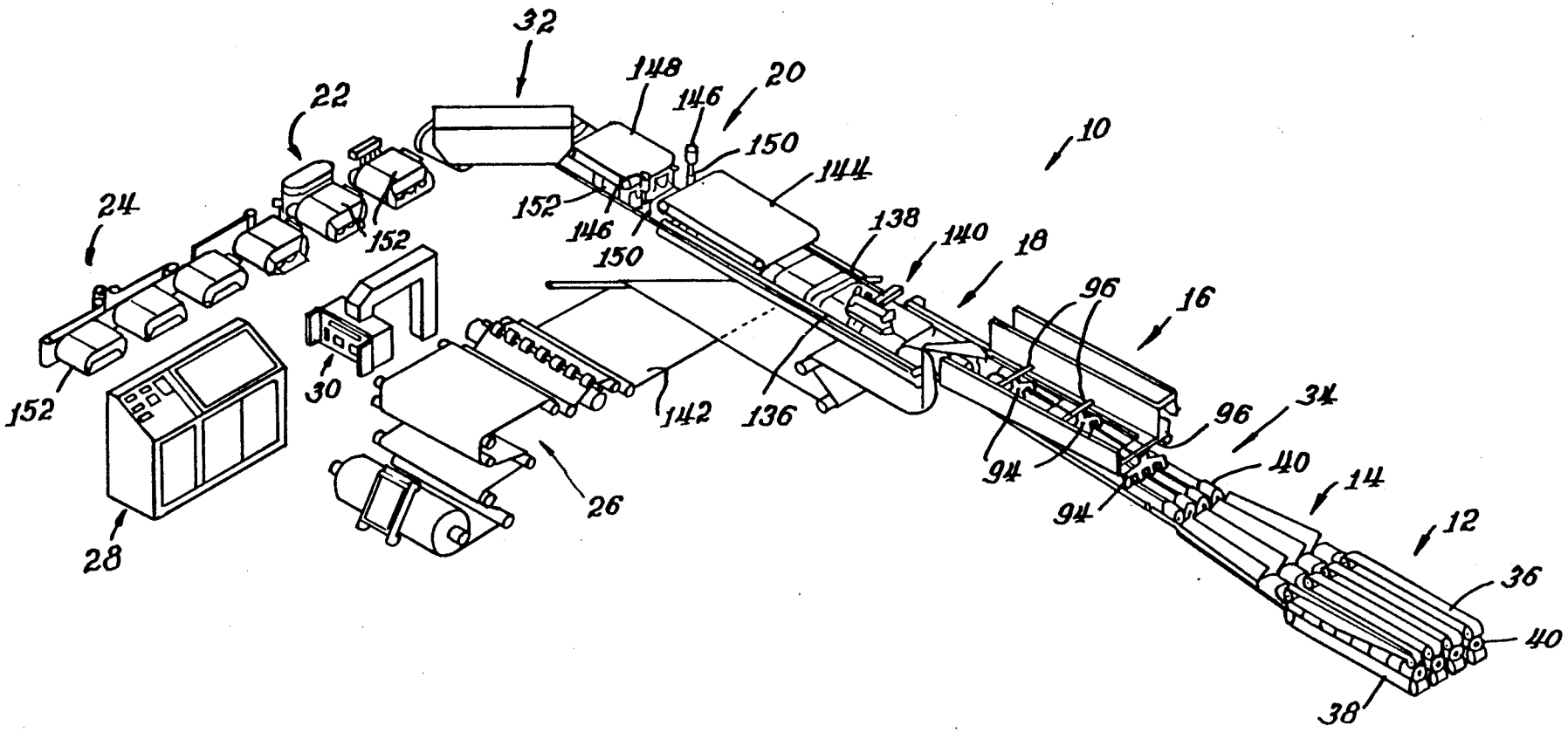
FIG. 1 is a schematic perspective overview of a compressed roll packaging apparatus according to the invention, with portions omitted to illustrate detail.

A compressed roll packaging machine according to the invention is shown generally at 10 in FIG. 1, and comprises several basic elements. The machine 10 first includes a roll compression section 12, where incoming cylindrical rolls are introduced (from a source not shown) and initially partially compressed. Next in sequence is a roll turning section 14, where the compressed rolls are rotated 90° about their longitudinal axes to a vertical orientation. The roll turning section 14 is followed by a forming shoulder overhead 16, where the rolls are aligned, conveyed in separate groups, and further compressed. A forming shoulder 18 follows, where the compressed groups of rolls are introduced into a plastic tube and the tube is longitudinally lap sealed. The partially-packaged product then advances to a separating section 20, where succeeding sections of the formed tube are separated. The separated sections then proceed to a folding section 22 where opposite ends of the tube are folded, and then to a side sealing section 24 where those ends are sealed.

Other basic components of the compressed roll packaging machine 10 are also illustrated in FIG. 1. Plastic film for the forming shoulder section 18 is distributed from a film handling section 26. Basic operating controls are located in a cabinet 28 (electrical connections to the various elements not being shown), and a master operation station 30 is provided for control of the roll packaging machine 10 (again electrical connections not being shown). Since the packaging machine 10 has a 90° turn between the separating section 20 and the folding section 22, an angle overhead section 32 is provided, although the turn is not necessary, and therefore the angle overhead section can be eliminated if the apparatus operates on a straight line. Finally, an acceleration conveyor 34 is located between the roll turning section 14 and the forming shoulder overhead section 16 to speed the rolls to the forming shoulder overhead section and create a spaced predetermined distance between rolls as soon as the rolls have been turned vertically.

Figure 2:
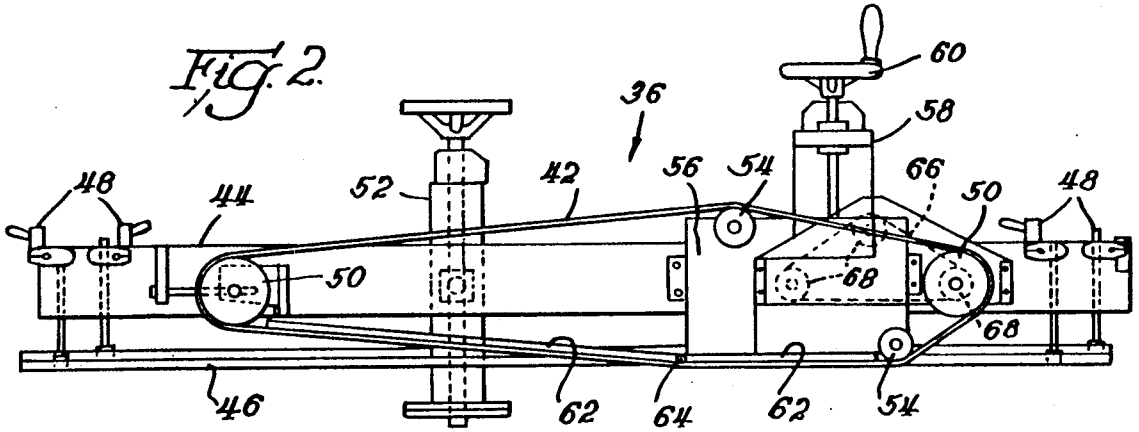
FIG. 2 is an enlarged side elevational view of a compression belt according to the invention.
Figure 4:
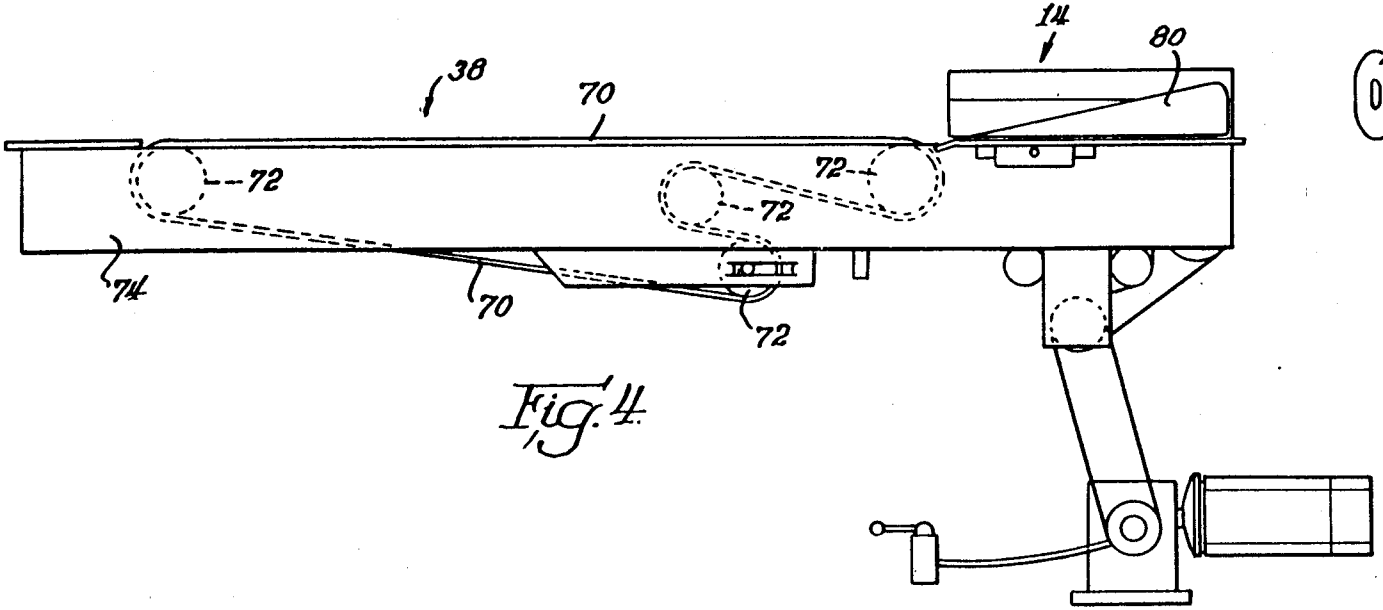
FIG. 4 is an enlarged side elevational view of a bottom conveyor used in conjunction with the compacting conveyor of FIG. 2, and also showing a side elevational view of the portion of the apparatus for turning the rolls.

The roll compression section 12 is composed of two basic components, a compacting conveyor 36 and a bottom conveyor 38 which are shown respectively in greater detail in FIGS. 2 and 4. The conveyors 36 and 38 are paired, with one pair of conveyors being provided for each line of paper rolls introduced into the packaging machine 10. In the machine 10 illustrated, four lines of paper rolls 40 are illustrated, but it will be evident to one skilled in the art that a fewer or greater number of lines of rolls can be accommodated by the apparatus depending on the package width ultimately desired.

Each compacting conveyor 36 comprises a conveyor belt 42 mounted on a horizontal frame 44. The frame 44 is appropriately held in place in the packaging machine 10 (means not illustrated). The frame 44 holds lane dividers 46 for dividing the various lanes of rolls 40. The dividers 46 are adjusted via adjustment controls 48.

The conveyor belt 42 extends about a pair of main pulleys 50 mounted on the frame 44. The height of the frame 44 can be adjusted with a vertical adjustment control 52. The vertical adjustment control 52 can be conventional, and is therefore not described or shown in greater detail.

The belt 42 also passes over a pair of slave pulleys 54. The pulleys 54 are mounted on a housing 56 secured to the frame 44. A housing adjustment control 58 is attached to both the frame 44 and the housing 56 for vertical adjustment of the housing 56. By rotation of a hand wheel 60, the housing 56 can be raised or lowered as required.

An angle compression plate 62 is located contiguous to the belt 42 between the left-most pulley 50 and the housing 56, and also beneath the housing 56. The angle compression plate 62 is in two sections, which are joined by a hinge 64. The hinge 64 is required since as the housing 56 is raised or lowered relative to the fixed pulleys 50, the angle between the two sections of the angle compression plate 62 must necessarily vary slightly.

Figure 3:
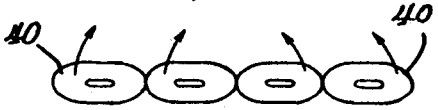
FIG. 3 is an end view of partially compressed rolls showing them in the orientation as they depart the compression belts of FIG. 2.

The angle compression plate 62 backs the conveyor belt 42 so that rolls entering the roll compression section 12 are compressed by the belt 42 in combination with the compression plate 62. The rolls exit the compacting conveyor 36 at the lower-most slave pulley 54 in a partially compacted state with their major cross-section axes extending substantially horizontally, as shown in FIG. 3.

The conveyor belt 42 is driven by the right-most main pulley 50. That pulley 50, in turn, is driven by a belt 66 passing about three small pulleys 68, one of which is coaxial with and attached to the right-most main pulley 50. The drive (not illustrated) for the belt 66 thus drives the belt 42 through the right-most main pulley 50. It is preferred that the belts 42 of each of the compacting conveyors 66 be driven in unison in order to deliver product at the same speed through each of the lines of the roll compression section 12.

As explained above, the rolls pass in the roll compression section 12 between the compacting conveyor 36 and bottom conveyor 38. The bottom conveyor 38, as shown in FIG. 4, comprises a choke belt 70 passing about a series of pulleys 72. The belt 70 may be separately driven, or may be driven only by paper rolls 40 entrained between the belt 70 and the belt 42. As is indicative by its name, the belt 70 can be adjusted to choke flow through the roll compression section 12. The pulleys 72 are mounted in a bottom frame 74, and the lowermost pulley 72 is adjustable to increase or decrease the tension of the belt 70.

Figure 6:
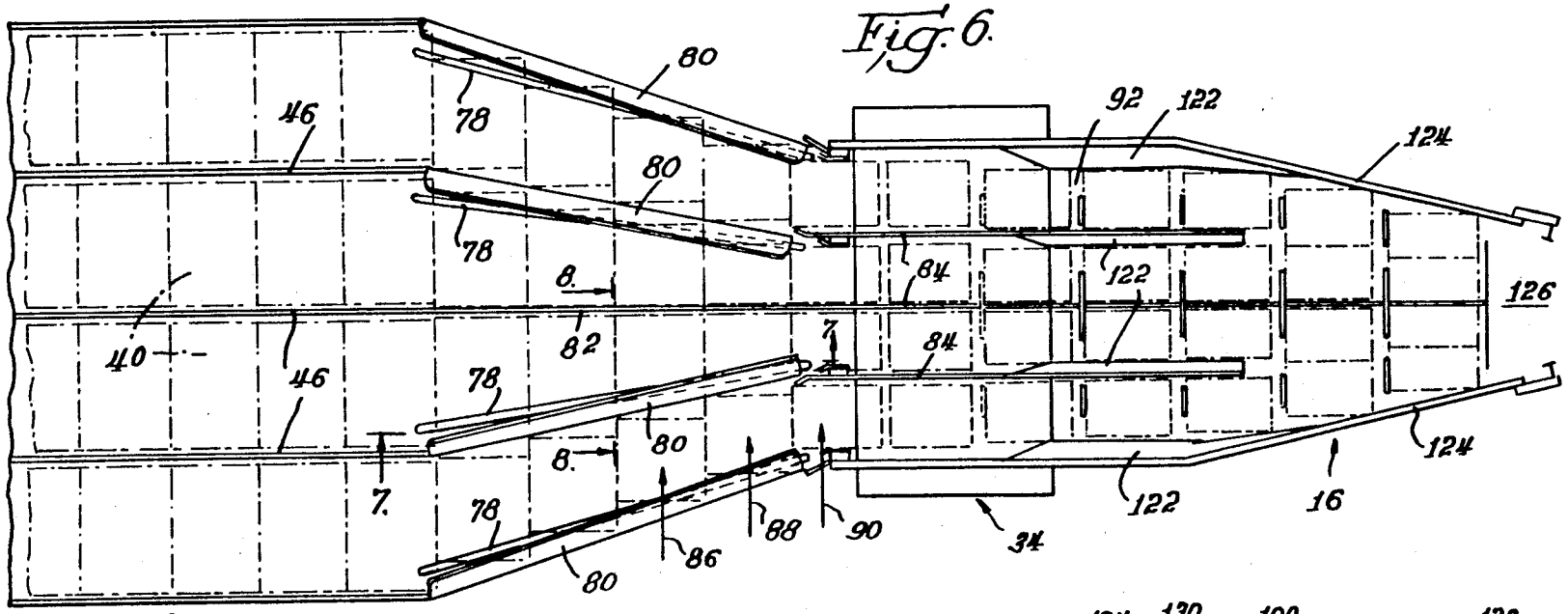
FIG. 6 is an enlarged overhead schematic view of a portion of the partial compressing section, roll turning section, and further compressing section according to the invention.
Figure 8:
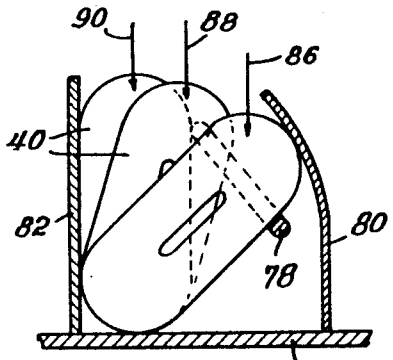
FIG. 8 is a further enlarged cross-sectional view taken along lines 8—8 of FIG. 6, showing a roll as it is progressively rotated to an upright orientation.
Figure 7:
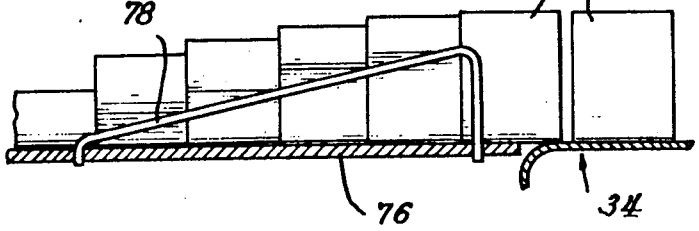
FIG. 7 is a further enlarged cross-sectional illustration taken along lines 7—7 of FIG. 6, showing the roll turning section.

The roll turning section 14 is also mounted on the frame 74. As best shown in FIGS. 6–8, the roll turning section 14 includes four chutes, one for each line of rolls exiting the roll compression section 12. Each of the chutes comprises a flat bottom 76 from which a lifting rail 78 rises, the rail 78 being upwardly inclined in the direction of travel of the rolls 40. Curling above the rails 78 in each of the lanes is a roll guide 80 which, as best shown in FIG. 8, helps guide the rolls 40 as they are elevated to an upright orientation. All chutes may be oriented as shown in FIG. 8, with a vertical guide 82 on one side, and the rails 78 and roll guide 80 on the other. Alternately, the chutes may be oriented in a left hand and right hand configuration as shown in FIG. 6, with the center two chutes being separated by a shared vertical lane divider 82 designed to keep adjacent rolls of the middle two lanes from contacting one another. In this configuration, relative to one another, two rolls are turned clockwise about their central axes while the other two rolls are turned counterclockwise.

Figure 5:
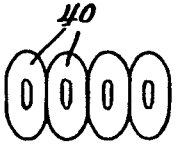
FIG. 5 is an end view of the orientation of the partially compressed rolls as they leave the roll turning section at the right end of FIG. 4.

When the rolls 40 exit the roll turning section 14, the rolls are upright as shown in FIG. 5. That is, the compressed rolls have a major cross-sectional axis which has been turned from horizontal (FIG. 3) to vertical (FIG. 5). The rolls are shown schematically in FIG. 5, and are actually separated by lane dividers 84 extending through the acceleration conveyor 34 and into the forming shoulder overhead section 16.

FIG. 3 has a series of arrows depicting the direction that each of the rolls 40 is raised in the roll turning section 14 due to the locations of the lifting rails 78. The rolls are rotated 90° from their positions shown in FIG. 3 to their positions shown in FIG. 5. It will be evident that, depending on the locations of the rails 78 and the guides 80, the rolls can be rotated 90° in either direction, so long as the rolls exit the roll turning section 14 in the orientation shown in FIG. 5.

The roll turning section 14 has no means to convey the rolls 40. Rather, the rolls 40 are each pushed by the next succeeding roll, with the rolls entering the roll turning section 14 being driven by the conveyors of the roll compression section 12.

FIG. 8 is a cross-sectional illustration in the lifting positions illustrated in FIG. 6. The rolls in FIG. 8 are shown in three downstream positions, a first position 86 in which the roll is elevated approximately 45°, a second position 88 in which the next ensuing roll has been elevated approximately 50% more, and a next position 90 at which the roll is fully elevated, and departing the roll turning section 14. At the positions 86–90 in each of the chutes in FIG. 6, the lifting rails 78 in each chute have lifted the rolls 40 to the orientations shown in FIG. 8.

After the rolls 40 have been elevated and exit the roll turning section 14, it is important that the rolls 40 be spaced before entering the forming shoulder overhead section 16. Thus, the acceleration conveyor 34 is located between the sections 14 and 16. The conveyor 34 is operated at a surface speed greater than the speed at which the rolls 40 are departing the roll turning section 14, thus spacing the rolls at least as much as shown in FIG. 6.

The rolls 40 exit the acceleration conveyor 34 onto a stationary dead plate 92 forming the bottom of the forming shoulder overhead section 16. The rolls thus temporarily halt forward motion, but are captured and pushed forwardly by overhead conveying means comprising a plurality of revolving spaced flights 94 illustrated in detail in FIG. 9. Each of the flights 94 is secured to a bar 96 which is connected at opposite ends to a chain conveyor (not illustrated in detail) which constantly circulates the flights 94 in a revolving fashion through the overhead section 16.

Figure 9:
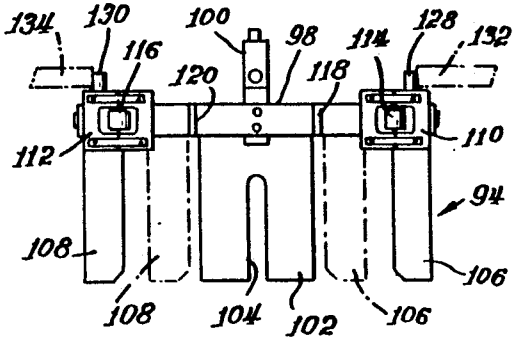
FIG. 9 is an elevational view of one of the revolving spaced flights according to the invention, FIG. 10 schematically illustrates four rolls as they initially enter the roll compression section according to the invention.

As illustrated in detail in FIG. 9, each of the flights 94 includes a horizontal beam 98. A support shaft 100 extends from the beam 98 to the bar 96 for support of and driving of the flight 94. A fixed paddle arm 102 is secured centrally to the beam 98. The paddle arm 102 has a central gap 104 which is located to straddle the central lane divider 84 extending into the forming shoulder overhead section 16. Shiftable paddle arms 106 and 108 are located on opposite ends of the beam 98. Each of the paddle arms 106 and 108 is mounted in a respective bracket 110, 112 which is slidably captured on the beam 98. Each of the brackets 110 and 112 includes a respective detent roller 114 and 116 which facilitates lateral shifting of the brackets 110, 112 and respective paddle arms 106, 108. In addition, the beam 98 includes two detents engagable by each of the detent rollers 114 and 116. The detent roller 114 engages a first detent (not illustrated) located directly beneath the detent roller 114 when in the position shown in FIG. 9, and a second detent 118 as illustrated. Similarly, the detent roller 116 engages a first detent (not illustrated) located directly beneath the detent roller 116 in the position shown in FIG. 9, and a second detent 120 as illustrated. The first detents (not illustrated) temporarily retain the paddle arms 106 and 108 and their associated brackets in the positions shown in bold in FIG. 9, while the second detents 118 and 120 temporarily retain the paddle arms 106 and 108 in the respective positions shown in phantom in FIG. 9. The shifting of the paddle arms 106 and 108 is to accommodate the reduction of width of the lanes for the rolls 40 as the rolls progress through the forming shoulder overhead section 16, as illustrated in FIG. 6.

Returning to FIG. 6, as the rolls in each lane are accelerated and enter the overhead section 16, the rolls 40 engage lane constrictions 122 in each of the four lanes. The lane constrictions are sized so that the widths of each of the lanes between the lane constrictions 122 and the lane dividers 84 are less than the widths of the rolls 40 as they enter the overhead section 16. Thus, initially the rolls stop when encountering the lane constrictions 122. However, immediately as the rolls enter the overhead section 16, a flight 94 engages the series of rolls, with the center two rolls being engaged by the bifurcated paddle arm 102, and the outer two rolls being engaged by the respective paddle arms 106 and 108. The flight then forces the rolls into the constricted lanes to further compress the rolls in the space allotted. In addition, as shown in FIG. 6, the forming shoulder overhead section 16 has converging outer border rails 124 constricting the effective cross-sectional dimension through which the rolls 40 may pass, therefore further compressing the rolls to an outlet 126. As can be seen in FIG. 6, as the border rails 124 begin to converge, the two outer lane dividers 84 terminate, allowing the outer pairs of rolls 40 to contact one another for the first time. As the border rails 124 further converge, the center lane divider 84 remains, and the two pairs of rolls 40 are compressed between the center lane divider 84 and the respective border rails 124. At the outlet 126, however, the lane divider 84 terminates, and therefore all four rolls 40 are in intimate contact just prior to entering the forming shoulder section 18.

As can be seen in FIG. 6, as the border rails 124 converge, the distance between the border rails 124 becomes less than the span of a flight 94 from the outer edge of the paddle arm 106 to the outer edge of the paddle arm 108. Each of the paddle arms 106, 108 is provided with a respective cam follower 128, 130 which, as the flight 94 is transported in the direction toward the outlet 126 of the overhead section 16, engage respective cam tracks 132 and 134. The Cam tracks 132 and 134 are fixed to the structure of the overhead section 16, and engage the respective cams 128 and 130 to progressively shift the paddle arms 106 and 108 toward the positions shown in phantom in FIG. 9. At the outlet 126, the paddle arms 106 and 108 are in the positions shown in phantom in FIG. 9, and cleanly avoid contact with the border rails 124. As the flights 94 are returned in their revolving path toward the inlet end of the forming shoulder overhead section 16, the cams 128 and 130 engage further cam followers (not illustrated) which spread the paddle arms 106 and 108 to return them to the orientation shown in bold fashion in FIG. 9, preparing the flight for initial engagement with further rolls 40 entering the forming shoulder overhead section 16.

Rolls exit the forming shoulder overhead section 16 in aligned, fully compacted rows, and immediately enter the forming shoulder section 18. In the forming shoulder section 18, an elongated plastic film 142 is formed in a conventional fashion into a lapped tube into which the rows of compacted rolls 40 are inserted. To maintain the compaction of the rolls 40 as they leave the exit 126, side compression conveyors 136 and 138, bearing on the outside of the formed plastic tube, retain the compression of the rolls 40 as the tube is longitudinally sealed. A conventional hot air lap sealer 140 is used to seal overlapping edges of the tube as it progresses through the forming shoulder section 18.

The rows of compacted rolls 40 exiting the forming shoulder overhead section 16 are spaced, and enter the plastic tube in a spaced fashion. The plastic film 142 forming the tube is fed from the film handling section 26. The film handling section 26 may be conventional, and properly tensions the film 142 to eliminate slack as it enters the forming shoulder section 18. In addition, the film handling section 26 laterally perforates the film 142 periodically to located perforations in the formed plastic tube between succeeding compressed rows of rolls 40. The perforations are later employed in the separating section 20 as the wrapped rolls are severed for completion of packaging.

The separating section 20 includes top and bottom pull belts 144. The pull belts 144 are driven at the same surface speed as the surface speed of the packaged rolls leaving the forming shoulder section 18. As the wrapped rolls 40 exit the pull belt 144, they pass paddle breakers 146 into top and bottom separator belts 148. The separator belts 148 are driven at a slightly greater surface speed than the surface speed of the pull belts 144, thus stretching the plastic film between the belts 148 and 144. The paddle breakers 146 are rotated with paddles 150 periodically striking the stretched plastic tube at the perforation lines between the succeeding rows of compressed rolls 40. The impact of the paddles 150 on the perforations is sufficient to sever the plastic tube, resulting in separate packages 152 with opposite open ends.

As the packages 152 exit the separator belt 148, the packages are engaged by the angle overhead section 32. The sole purpose of the angle overhead section 32 is to change the direction of movement of the packages 152 so that the packages travel in a direction perpendicular to the cores of the compacted rolls 40 rather than in the previous direction which was parallel to the cores of the rolls. Any suitable apparatus can comprise the angle overhead section 32 for this purpose.

Packages 152 exiting the angle overhead section 32 enter the folding section 22. The folding section 22, in what may be a conventional fashion, sequentially folds open ends of the packages 152, and passes the packages to the side sealing section 24, which seals the folded package ends. Thus, the packages are fully sealed with compressed rolls 40 contained therewithin as the packages exit the side sealing section 24.

The folding and sealing of the folded ends of the packages 152 may be completed in any fashion, the details of which do not form any part of the present invention.

Figure 10:
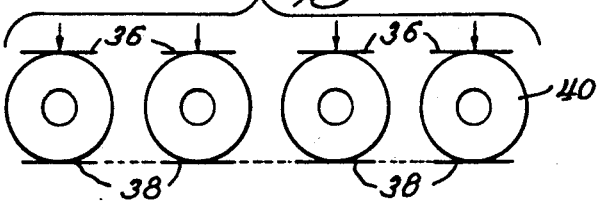
Figure 11:
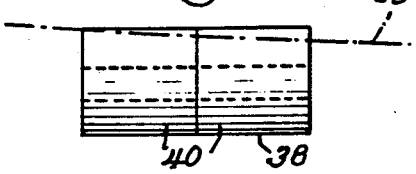
FIG. 11 is a side elevational view of the rolls of FIG. 10.

FIGS. 10–15 schematically illustrate the various steps of the process according to the invention as the rolls 40 are compressed prior to packaging within the tubular film 142. In FIG. 10, the rolls 40 are shown schematically within the roll compression section 12, as they are conveyed on the bottom conveyors 38 and are initially compacted by the top compacting conveyors 36. The side view in FIG. 11 shows the descending angle of the conveyors 36 as compacting of the rolls 40 progresses.

Figure 12:
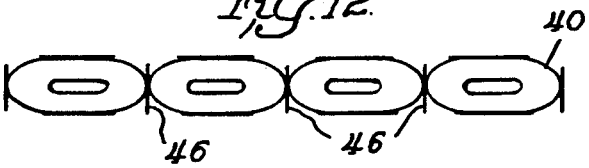
FIG. 12 is an end elevational view of the rolls as they are partially compressed, and just prior to entering the roll turning section.
Figure 13:
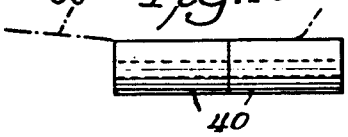
FIG. 13 is a side elevational view of the rolls of FIG. 12.
Figure 14:
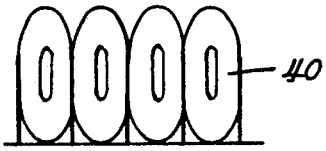
FIG. 14 illustrates the elevated rolls in a fully compressed state prior to being wrapped in plastic film.
Figure 15:
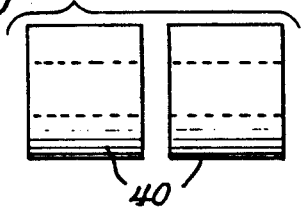
FIG. 15 is a side elevational view of the rolls of FIG. 14.

FIG. 12 illustrates the rolls 40 in the partially compacted state as they exit the roll compression section 12 and enter the roll turning section 14, being separated by the lane dividers 46. As shown by the arrows in FIG. 12, and as explained in further detail above, all of the rolls 40 can be turned in one direction, or the rolls 40 can be turned in opposite directions, as desired, so long as the rolls are upended 90° with their major cross-sectional dimension being oriented generally vertically.

The thus-oriented rolls, still separated by lane dividers 84, are accelerated and aligned in rows as they enter the forming shoulder overhead section 16. The paddle arms 102, 106 and 108 of the flights 94 then convey the aligned rolls in a row through the forming shoulder overhead section 16, where the rolls are further compressed to the configuration shown in FIG. 14, with the rolls of each row being joined. The succeeding rows, spaced from each other, enter the forming shoulder section 18 where the rolls are wrapped in the film 142, and the film is longitudinally sealed into a tube. The rows of rolls 40 in the tube then enter the separating section 20, where the film is stretched, separated on perforations by the paddles 150, and transported to the angle overhead section 32, where the packages 152 are transported to the folding section 22 for folding of the ends, and then to the side sealing section 24, where the ends of the packages 152 are sealed.

It should be evident from the schematic illustration in FIG. 1 that several elements of the invention have been omitted in order to illustrate detail. For example, conveyors for conveying the packages 152 through the folding section 22 and side sealing section 24 have been omitted. In addition, it should be apparent that folding of the packages 152 in the folding section 22 occurs at both ends of the packages, and apparatus has been shown at one end only. Similarly, in the side sealing section 24, both ends of the packages 152 are sealed, but apparatus is shown on only one end of each of the packages 152 in order to show the ends of the packages in their folded and sealed state.

Figure 17:
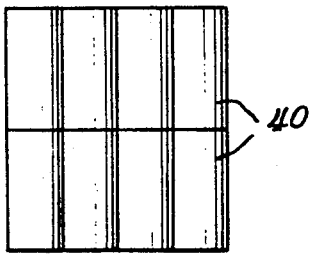
FIG. 17 is a view similar to FIG. 16, but with eight rolls in the package.
Figure 18:
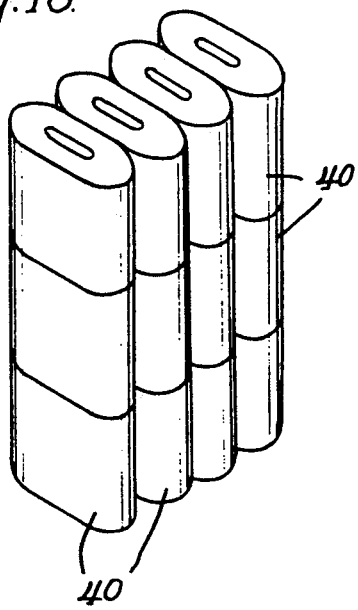
FIG. 18 is a perspective view of a package similar to FIGS. 16 and 17, but with twelve rolls comprising the package.
Figure 16:
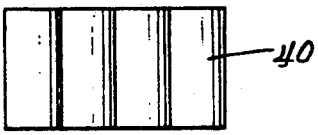
FIG. 16 illustrates one possible package of rolls according to the invention, where four fully-compressed rolls are packaged side-by-side, with the packaging film being eliminated to illustrate detail.

The above detailed description of the invention has generally been in relation to forming a package of a single row of four rolls 40 in the compressed state, as shown in FIG. 16. However, it will be evident that multiple rows of compressed rolls can be packaged together, as shown in FIGS. 17 and 18. By appropriate spacing of the flights 94, two or more rows of rolls 40 can be accumulated in the forming shoulder overhead section 16 as the rolls are further compressed. By appropriate spacing of perforations in the film 142, packages 152 can thus be formed with multiple rows of rolls 40.

In addition, the rolls 40 shown in the drawings correspond generally to toilet paper rolls. Paper towel rolls are longer, and again the apparatus of the invention can readily accommodate longer rolls essentially by changing the spacing of the flights 94 and appropriately spacing the lateral perforations in the film 142.

Finally, the spacings between the rows of rolls 40 on the acceleration conveyor and in the forming shoulder overhead section 16 are shown somewhat less than may normally occur in order to clearly show the progression of the rolls 40 through the machine 10. The rows of rolls 40 must be sufficiently separated so that enough plastic film results between separated rows of rolls so that the film can be folded and sealed to complete the packages 152. The amount of spacing needed between the rows of rolls will be evident to one skilled in the art.

When the packages 152 are opened by a consumer, obviously it is important that the compressed rolls 40 be capable of being returned to a generally cylindrical configuration. Thus, it is imperative that the rolls 40 not be overcompressed. A typical roll of about a $4\frac{1}{4}$ inch diameter can be compressed to a two inch depth without overcompressing the roll and preventing easy reconstruction of the roll when the package 152 is opened. Compression of the roll to a two inch depth expands the width of the roll from about $4\frac{1}{4}$ inches to about $5\frac{1}{4}$ inches. Thus, compression of the rolls results in a substantial savings of space, and four compressed rolls can be packaged in a volume less than that occupied by three uncompressed rolls. The rolls, when compressed, tend to try to return to a partially uncompressed state, and therefore rolls compressed to a two inch depth will grow slightly before and during packaging to a depth greater than two inches. Typically, when a row of four rolls exits the forming shoulder overhead section 16 into the forming shoulder section 18, the height of the row of four rolls will be about five inches, with the overall width about $8\frac{3}{4}$ inches.

Because of the compression of the rolls 40 and detention of the rolls 40 in a compressed state as the rolls progress through the compression section 12, roll turning section 14, accumulation conveyor 34 and forming shoulder overhead section 16, stationary parts of the machine 10 can be coated with a low friction coating, such as Teflon, in order to reduce friction. Thus, it is preferred that lane dividers, guides and all stationary constriction parts be appropriately coated to reduce friction both to reduce the energy needed to convey the rolls through the packaging machine 10, and also to reduce or avoid any damage to the rolls 40 as they are compressed and conveyed.

Various changes can be made to the invention without departing from the spirit thereof or scope of the following claims.

What is claimed is:

1. A method of packaging a plurality of cylindrical paper rolls in a compressed state, comprising the steps of a. orienting at least two rolls in a generally side-by-side relationship having their longitudinal axes parallel and horizontal, b. conveying the rolls in a direction of travel parallel to the longitudinal axes of the rolls, c. progressively compressing the rolls to a partially compressed state as the rolls are conveyed such that each roll has a generally elliptical cross section with a major cross-sectional axis, d. orienting the partially compressed rolls with their major cross-sectional axes spaced a first predetermined distance and parallel to one another, e. further compressing the rolls to a compressed state such that their major cross-sectional axes are spaced a second predetermined distance which is less than said first predetermined distance, and f. sealing said rolls in a package while in the compressed state.

2. A method according to claim 1 in which method step "d" includes rotating each roll 90° about its longitudinal axis.

3. A method according to claim 2 in which rotating of each roll occurs as the roll is conveyed.

4. A method according to claim 1 in which the rolls are maintained in a spaced relationship for method steps "a" through "d" and are joined in contact by the completion of method step "e".

5. A method of packaging a plurality of cylindrical paper rolls in a compressed state, comprising the steps of a. orienting at least two rolls in a generally spaced, side-by-side relationship having their longitudinal axes parallel and horizontal, b. conveying the rolls in a direction of travel parallel to the longitudinal axes of the rolls, c. progressively compressing the rolls to a partially compressed state as the rolls are conveyed such that each roll has a generally elliptical cross section with a major cross-sectional axis lying horizontally, d. rotating each partially compressed roll 90° about its longitudinal axis as the roll is conveyed so that the rolls are oriented with their major cross-sectional axes vertical and spaced a first predetermined distance from one another, e. aligning the partially compressed rolls in a row while maintaining the rolls spaced apart, f. further compressing the rolls to a compressed state such that their major cross-sectional axes are spaced a second predetermined distance which is less than said first predetermined distance, and g. sealing said rolls in a package while in the compressed state.

6. A method according to claim 5 in which method step "g" includes the steps of conveying the compressed rolls into a plastic tube while maintaining the rolls in a compressed state, the plastic tube being formed from an elongated film with side edges overlapped to form the tube, and sealing the overlapped side edges.

7. A method according to claim 5 in which method step "f" includes the steps of conveying the spaced rolls and further compressing the rolls as they are conveyed, joining at least two of said rolls in contact with one another and further compressing the rolls when joined.

8. An apparatus for packaging a plurality of cylindrical paper rolls in a compressed state where at least two rolls are initially oriented in a generally side-by-side relationship having their longitudinal axes parallel and horizontal, comprising a. means for conveying the rolls in a direction of travel parallel to the longitudinal axes of the rolls, b. means for progressively compressing the rolls to a partially compressed state such that each roll has a generally elliptical cross section with a major cross-sectional axis, c. means for orienting the partially compressed rolls with their major cross-sectional axes spaced a first predetermined distance and parallel to one another, d. means for further compressing the rolls to a compressed state such that the major cross-sectional axes of the rolls are spaced a second predetermined distance which is less than said first predetermined distance, and e. means for sealing said rolls in a package while in the compressed state.

9. An apparatus according to claim 8 in which said means for conveying comprises a bottom conveyor located beneath said rolls and in which said means for progressively compressing comprises at least one compacting conveyor located above said bottom conveyor, and including means for angling said compacting conveyor in the direction of travel for reducing spacing between said conveyors to compress said rolls.

10. An apparatus according to claim 9 in which said means for angling comprises a compression plate bearing against said compacting conveyor, and means connected to said plate for adjusting said plate to alter the spacing between said conveyors.

11. An apparatus according to claim 8 in which said means for orienting includes a chute for each roll and a lifting rail in each chute at one side thereof, said lifting rail being upwardly inclined in the direction of travel.

12. An apparatus according to claim 8 including an acceleration conveyor located between said means for orienting and said means for further compressing.

13. An apparatus according to claim 8 in which said means for further compressing comprises a lane for each roll, means in each lane for compressing a roll, and overhead conveying means for transporting said rolls in unison.

14. An apparatus according to claim 13 in which at least some of said lanes converge toward one another, and said overhead conveying means comprises a plurality of revolving spaced flights.

15. An apparatus according to claim 14 in which each spaced flight comprises a horizontal beam and a pair of paddle arms shiftably mounted on opposite ends of said beam.

16. An apparatus according to claim 15 in which each arm includes a detent roller in registration with said beam and said beam includes a pair of corresponding detents associated with each said arm, said roller engaging said detents.

17. An apparatus according to claim 15 in which each arm includes a cam roller, and including a cam in registration with each cam roller, said cam being mounted adjacent said overhead conveying means.

18. An apparatus according to claim 8 in which said means for sealing includes means for forming an elongated plastic film into a tube with lapped edges, and means for heat-sealing said lapped edges.

19. An apparatus according to claim 18 including means for separating said tube into sections, and means for sealing opposite ends of each tube section.

* * * * *